US008510869B1

(12) United States Patent
McCrady et al.

(10) Patent No.: US 8,510,869 B1
(45) Date of Patent: Aug. 20, 2013

(54) REAR LOOKING SNOW HELMET

(76) Inventors: Dennis Drake McCrady, Albuquerque, NM (US); Jeffrey Scott Tonigan, Albuquerque, NM (US)

( * ) Notice: Subject to any disclaimer, the term of this patent is extended or adjusted under 35 U.S.C. 154(b) by 0 days.

(21) Appl. No.: 13/403,671

(22) Filed: Feb. 23, 2012

(51) Int. Cl.
*A42B 1/06* (2006.01)

(52) U.S. Cl.
USPC ..... 2/410

(58) Field of Classification Search
USPC ..... 2/410, 6.1, 6.6, 423, 10; 340/4.42, 340/435, 474, 475, 480, 539.22, 545.3, 572.7; 362/105, 106, 107
See application file for complete search history.

(56) References Cited

U.S. PATENT DOCUMENTS 6,097,315 A * 8/2000 Minter ..... 340/961
6,594,614 B2 * 7/2003 Studt et al. ..... 702/150
6,861,970 B1 * 3/2005 Garland ..... 342/20
7,095,315 B2 * 8/2006 Lemke ..... 340/435
8,060,149 B1 * 11/2011 Louis et al. ..... 455/569.1
8,269,619 B2 * 9/2012 Lee ..... 340/475

* cited by examiner

*Primary Examiner* — Tejash Patel

(57) ABSTRACT

A technique for alerting a user of approaching moving objects from the side or rear includes a rear looking radar with audio alerts to the user. Feasibility of the Rear Looking Snow Helmet is shown using the skiing and snowboarding applications where variable frequency (distance related) audio alerts are provided to left and right earphones depending on the location of the approaching skier/snowboarder. The electronics driving the system are mounted in the skier's/snowboarder's helmet while two antenna elements are mounted on the rear of the helmet. A large ON/OFF switch is mounted on the helmet for easy access. We show feasibility of the concept using performance analysis and by proposing an implementation architecture for the skiing and snowboarding applications. We claim the system will meet an acceptable level of performance when parameters are varied and traded off and that the system is technology independent.

3 Claims, 6 Drawing Sheets

| PARAMETER | VALUE |
|---|---|
| 1. Safety | |
| • Reaction Time | 1.5 – 4.5s depending on Δv |
| • Warning Time | < .5s with detection processing |
| 2. Area of Operation | |
| • Number of Beams | 2 at $\pm 30^0$ |
| • Beamwidth | $30^0$ |
| • Maximum Range | 10m |
| 3. Operating Frequency | 5.8GHz (3rd ISM Band, λ = .052m) |
| 4. Transmit Power | 2mW |
| 5. Bandwidth | |
| • RF Bandwidth | 2MHz |
| • Chip Rate | 2Mcps |
| • Code Length | 1024 chip Hadamard Code |
| • Correlation Time | .5ms (= $1024/2x10^{-6}$) |
| 6. Antenna Array | |
| • Number of Elements | 2 |
| • Element Type | Dielectric Patch |
| 7. Detection | |
| • Pd | > 99.99% |
| • Pfa | $< 10^{-6}$ |
| 8. Modulation Type | BPSK, DSSS |
| 9. Coherence Time | < 3.3ms (5 – 15mph) |
| 10. Electronics Package | Estimates include battery |
| • Size | 1.5" X 1.5 x .75" |
| • Weight | 6oz |
| • Power | 2 days per charge |

FIG.2

2, 3, 7 pings for 15, 10, 5 mph differential velocity, respectively, between 10m initial detection and 2m threshold

REAR LOOKING SNOW HELMET

CROSS REFERENCE TO RELATED APPLICATIONS (IF ANY)

None.

STATEMENT OF FEDERALLY SPONSORED RESEARCH/DEVELOPMENT (IF ANY)

None.

NAMES OF THE PARTIES TO A JOINT RESEARCH AGREEMENT IF THE CLAIMED INVENTION WAS MADE AS A RESULT OF ACTIVITIES WITHIN THE SCOPE OF A JOINT RESEARCH AGREEMENT

None.

REFERENCE TO A "SEQUENCE LISTING," A TABLE, OR A COMPUTER PROGRAM LISTING APPENDIX SUBMITTED ON A COMPACT DISC AND INCORPORATION BY REFERENCE OF THE MATERIAL ON THE COMPACT DISC. THE TOTAL NUMBER OF COMPACT DISCS INCLUDING DUPLICATES AND THE FILES ON EACH COMPACT DISC SHALL BE SPECIFIED

None.

BACKGROUND OF THE INVENTION

There are many situations during a typical skiing or snowboarding day in which skiers and snowboarders would appreciate having eyes in the back of their heads. Whether cruising down a wide open slope, merging with an adjacent trail, or transiting a slope or trail on a catwalk, being able to "see" sideways or backwards provides a new level of safety to skiers and snowboarders of all abilities. Not all skiers and snowboarders are cautious or make a concerted effort to obey the rules of skiing or snowboarding etiquette. It is not uncommon to observe skiers and snowboarders of limited ability barreling down a slope out of control colliding with or nearly missing unsuspecting, controlled skiers and snowboarders on the same slope. Other skiers and snowboarders can be seen projecting themselves out of the trees at the side or bottom of a trail without concern for passing skiers or snowboarders. The same situation occurs at trail merges where the out of control skier or snowboarder on one trail could be just above an unsuspecting skier or snowboarder on the other trail as they merge. Catwalks across slopes provide multiple situations for concern. Skiers or snowboarders traversing the slope on the catwalk are vulnerable to uphill skiers or snowboarders and the uphill skiers' or snowboarders' ability to avoid them. Also in play are the skiers and snowboarders below the catwalk should the uphill skier or snowboarder decide to jump off the edge of the catwalk without seeing the skier or snowboarder below the catwalk. The uphill skier or snowboarder will be airborne when seeing the skier or snowboarder below the catwalk making it very difficult to avoid a collision.

The danger in all of the above examples can be reduced or avoided if the vulnerable skiers and snowboarders had the ability to "see" to the side or behind themselves as they proceed downhill. The ability to "see" can take many forms. Skiers or snowboarders could constantly turn their heads from side to side in search of encroaching skiers or snowboarders turning themselves into partially blind, dangerous projectiles. Skiers and snowboarders could wear rear view mirrors on their helmets to reduce the amount of time required to scan behind them. But they still need to focus on the rear view mirror; time spent not looking for other skiers or snowboarders in their own downhill path. Rear view mirrors are also susceptible to frost, fog, and snow, all of which reduce visibility and lead to periodic cleaning, an irritant taking away from the free skiing or snowboarding experience. Skiers and snowboarders could mount video cameras to the rear of their helmets and use a heads up display in their goggles to view the rearward video scene. This approach suffers the same disadvantages as the rear view mirror in addition to being very expensive.

The approach proposed in this patent allowing skiers and snowboarders to "see" beside or behind themselves avoids the problems described above. In general the proposed approach uses a rear looking radar with audio alerts. The small size, power, and weight of the radar allow it to be mounted in the helmet. The audio alert warning of an encroaching skier or snowboarder allows the skier or snowboarder to continue to look downhill while performing an evading maneuver. Evading maneuvers could be quick turns to the right or left or stops to the right or left depending on the audio alert and the situation.

There are radar warning systems for automobiles that look forward[1], sideways[2], and to the rear[3,4,5] for example, but none fit the skiing and snowboarding applications. The skiing and snowboarding applications require small, lightweight, low dissipated power, low transmit power (to maximize user safety), limited field of view, low delay, quick reaction time, and rear looking radar detecting a forward moving target. While the inventors have not found a suitable, off-the-shelf device in the open literature, there are capable systems[1] that could be modified to meet the specific skiing and snowboarding requirements. In addition, the inventors claim that a system similar to that described herein could be built with different system parameters while meeting similar requirements and objectives for the skiing/snowboarding application and for a pedestrian application.

[1]R. Stevenson, "A Driver's Sixth Sense," IEEE Spectrum, October 2011, pp 50-55.

[2]Delphi Automotive Systems, http://www.prnewswire.com/news-releases/delphis-collosion-avoidance-systems-take-accident-prevention-to-the-next-level Feb. 23, 1998.

[3]M. Rao, "Accident Avoidance During Vehicle Backup," U.S. Pat. No. 7,772,991 B2, Aug. 10, 2010.

[4]B. Osborne, http://www.geek.com/articles/gadgets/audiovox-offers-easy-wireless-collision-avoidance-solution, Jun. 17, 2008.

[5]P. Seiler, et al, "Development of a Collision Avoidance System," Society of Automotive Engineers, 98PC-417, 1998.

BRIEF SUMMARY OF THE INVENTION

A technique for alerting a skier/snowboarder of approaching skiers/snowboarders from the side and rear includes a rear looking radar with audio alerts to the user. Feasibility of the Rear Looking Snow Helmet (RLSH) will be shown. The electronics driving the system are mounted in the skier's/snowboarder's helmet while two antenna elements are mounted within or on the rear of the helmet. A large, ski glove friendly ON/OFF switch is mounted on the outer shell of the helmet for easy access when the skier/snowboarder reaches the bottom of the run, for example, where false alarms could be generated by the motion of skiers/snowboarders approaching ski lifts or walking to the cafeteria. Stationary objects like trees, ski lift towers, or resting skiers/snowboarders are eliminated using standard radar clutter rejection techniques. The system uses ±30° rear looking beams and provides an audio alert to the left earphone if a skier/snowboarder is detected in the +30° beam and an audio alert to the right earphone if a skier/snowboarder is detected in the −30° beam. A higher audio frequency indicates a closer range and a lower audio frequency indicates a longer range to the approaching skier/snowboarder. The RLSH is transparent to the user until an approaching skier/snowboarder triggers an alert that may require the user to make a protective maneuver.

Sophisticated radar systems are available today that are more than capable of fulfilling the needs of the RLSH. We suggest that current technology could be modified and simplified to implement our proposed system. Future technology could be used to further simplify and reduce size, power, weight, and cost. We maintain that the RLSH is technology independent. Our main goal here is to show that the system is feasible today and deserving of patent coverage. We provide Key Performance Parameters for the skiing and snowboarding applications that yield an operational system design coupled with performance analysis to demonstrate functionality and precision. Conclusions from our performance analysis show that the RLSH will detect approaching skiers/snowboarders in the 10 m, ±30° beam observation window with a probability of detection >99.9%, a probability of false alarm $<10^{-6}$, and with a range accuracy of 1.5 m. In addition, a Sequencing and Alerting Algorithm will have access to data from multiple pings and provide range proportional audible alerts so the user can evade or prepare for the encroaching skier/snowboarder.

The above and further features and advantages of the invention will become apparent after considering the following descriptions and figures. While these descriptions and figures go into specific details of the invention for a specific skiing and snowboarding application, it should be understood that variations may and do exist and would be apparent to those skilled in the art. For example, many of the system parameters could be varied and another system could be designed to meet similar performance requirements and objectives for skiers/snowboarders or pedestrians.

BRIEF DESCRIPTION OF THE SEVERAL VIEWS OF THE DRAWING (IF ANY)

FIG. 2 is a table that lists key performance parameters for the Rear Looking Snow Helmet for both skiing and snowboarding applications.

DETAILED DESCRIPTION OF THE INVENTION

Introduction

The invention overcomes the aforementioned dangers of downhill skiing and snowboarding. Using a rear looking radar with audio alerts mounted in the skier's/snowboarder's helmet allows the skier/snowboarder to focus attention on the fall line below knowing an audio alert will warn of encroaching skiers/snowboarders from the side or behind. This enables the skier/snowboarder to ski more confidently, enjoying a safer free skiing and snowboarding experience while improving the safety of fellow skiers/snowboarders as well.

Figure 1:
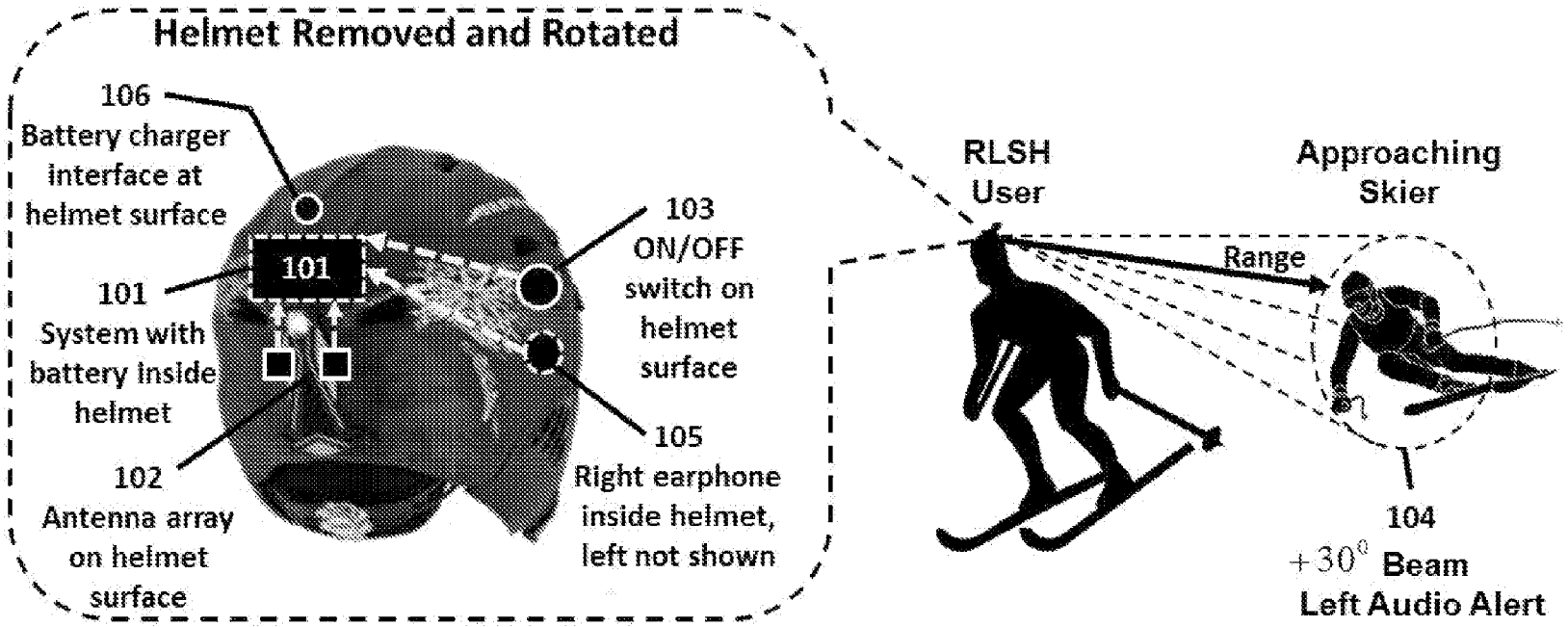
FIG. 1 is a sketch of the Rear Looking Snow Helmet concept for the skiing and snowboarding applications depicting the operational use of the system as well as showing how the system is mounted within and on the snow helmet.

As shown in the non-scale concept sketch in FIG. 1, the RLSH contains a small rear looking radar system 101 mounted on and inside the helmet. This system detects encroaching skiers/snowboarders then warns the user. The electronics driving the system are mounted in the helmet liner while a two element antenna array 102 is mounted within or on the outer shell of the helmet. A large, ski glove friendly ON/OFF switch 103 is mounted on the outer shell of the helmet for easy access when the skier/snowboarder reaches the bottom of the ski trail, for example, where false alarms from slow moving, benign targets could be generated. The benign targets could be skiers or snowboarders on or off their skis or snowboards moving toward a ski lift or the cafeteria. The system uses ±30° rear looking beams that provide rear and ample side coverage. If an approaching skier/snowboarder is detected in the +30° beam 104, the system will generate a variable frequency audio alert to the left earphone 105, where a higher audio frequency indicates a closer range and a lower audio frequency indicates a longer range to the approaching skier/snowboarder. Likewise, if an approaching skier/snowboarder is detected in the −30° beam, the system will generate an audio alert to the right earphone. A rechargeable battery is included in the electronics package with a recharging interface 106 on the surface of the helmet. The RLSH is transparent to the user until an approaching skier/snowboarder triggers an alert that may require the user to make a protective maneuver.

Figure 3:
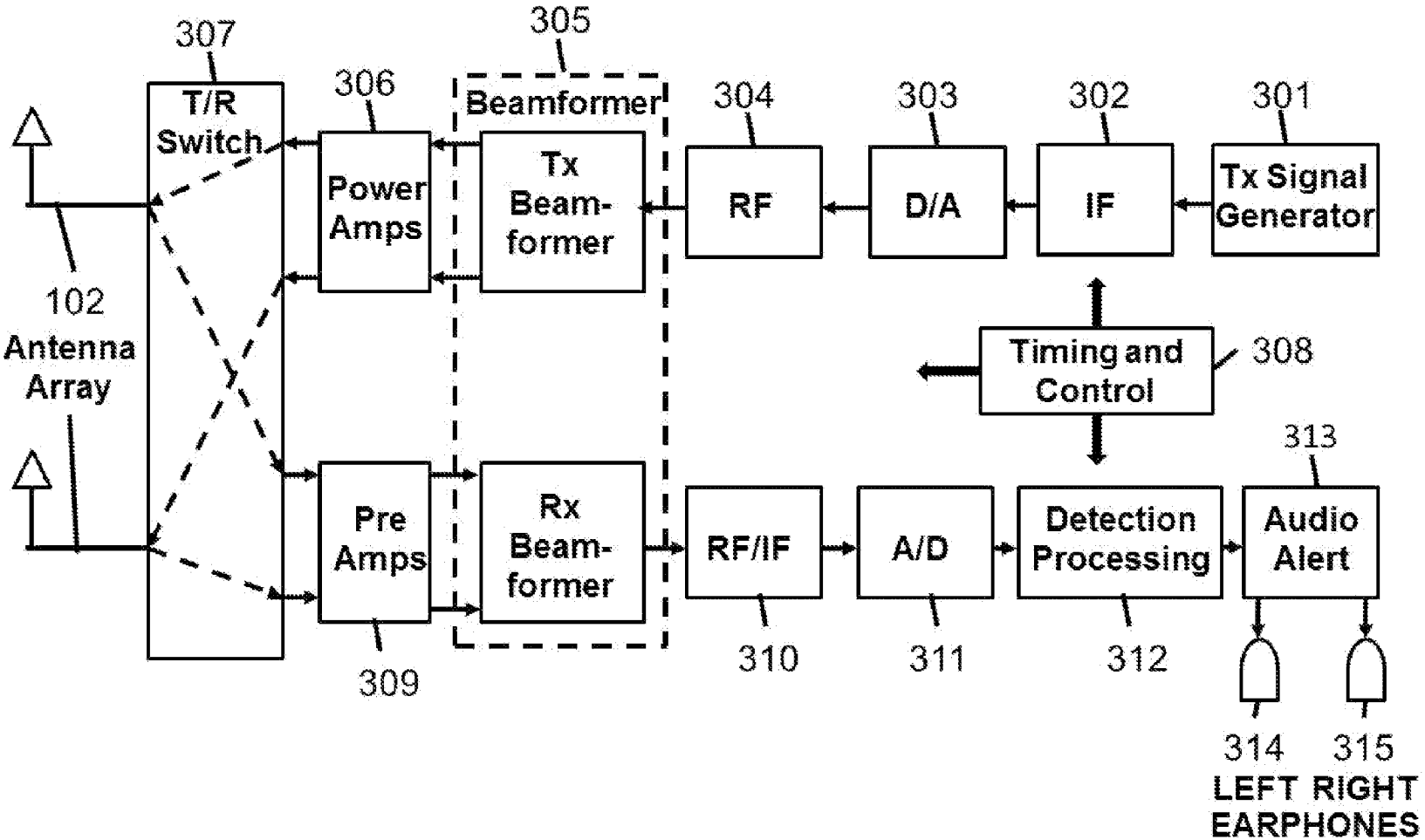
FIG. 3 is a system block diagram of the key functions and signal flow of the Rear Looking Snow Helmet.

A key component in the RLSH is the radar system. Sophisticated radar systems are available today[1] that are more than capable of fulfilling the needs of the RLSH. We suggest that current technology could be modified (simplified) to implement the RLSH. Future technology could be used to further simplify and reduce size, weight, power, and cost, i.e. the RLSH is not technology dependant. Key performance parameters for the generic rear looking radar for the skiing and snowboarding applications are shown in FIG. 2. Note that size, weight, and power (SWAP) are technology dependent. The initial prototypes could be implemented with Altera or Xilinx Field Programmable Gate Arrays (FPGAs) which may not initially meet the desired SWAP goals. When a final design is crafted in state-of-the-art Application Specific Integrated Circuit (ASIC) technology such as that used by the Infineon/Bosch team[1] or Freescale Semiconductor[1], the SWAP goals should be easily met. Reducing the 500 MHz bandwidth used by Infineon/Bosch to 2 MHz for the RLSH provides an approximate clocking reduction scale factor of 250 leading to our optimism for meeting the SWAP goals in a production system. Further detail will be provided below for the Key Performance Parameters as they relate to the System Block Diagram in FIG. 3 and as they are used to show feasibility of the RLSH. FIG. 3 shows a feasible architecture for implementing the RLSH. This architecture is based on digital signal generation in the transmitter and digital signal processing in the receiver. There are many architectures that could be applied to the RLSH involving various mixes of digital and analog hardware. There will be additional architecture choices as technology advances in the future. The purpose here is to show that the RLSH concept is feasible today while not limiting the current and future implementation possibilities.

System Description

Referring to the transmitter side of FIG. 3, the Transmit Signal Generator 301 and the Intermediate Frequency (IF) 302 are typically prototyped in an FPGA, as mentioned above, in a digital baseband design. Current FPGA densities and speeds available from Altera or Xilinx are more than adequate given the sampling and chip rates being used. Once prototyped and tested, the final design can be implemented in ASIC technology, as mentioned above. The Transmit Signal Generator is where the 2 Mcps (Mega-chips per second), 1024 chip BPSK (Binary Phase Shift Keyed) signal is implemented and transmitted to start the precision timing for the radar range gate used to measure the distance to the encroaching skier/snowboarder. The transmitted signal is then passed to the IF. The baseband signal is translated to a digital IF within the bandwidth of the Digital-to-Analog (D/A) Converter then converted to an analog signal by the D/A converter 303. A typical IF is 70 MHz leading to a D/A converter sampling rate on the order of 100 MHz, a reasonable rate for current 10-12 bit D/A's, providing ample resolution for the RLSH application. The Radio Frequency (RF) function 304 translates the signal to 5.8 GHz, the third Industrial, Scientific, and Medical (ISM) band where few restrictions apply, interference is unlikely, and off the shelf components are available. The Beamformer 305 consists of Transmit (Tx) and Receive (Rx) functions. The Tx Beamformer generates the two beams at ±30° used to discriminate whether a skier/snowboarder is approaching from behind on the right or left side. A simple ±90° phase shift yields ±30° beams, respectively. The Power Amplifiers 306 amplifies the phase shifted RF signals from the beamformer to 2 mW and applies them through the Transmit/Receive (T/R) Switch 307 to the Antenna Array 102. Timing and Control 308 is implemented in a General Purpose Processor (GPP) and controls timing of the transmit signal from generation through setting of the T/R Switch in the transmit position at the appropriate time. The GPP can be purchased from Intel or implemented as a standard building block in an FPGA depending on desired functionality and complexity.

Referring to the receive side of FIG. 3, the Timing and Control GPP 308 sets the T/R switch in the receive position at the appropriate time and the signals from the antenna array are routed through Preamplifiers 309 to the Rx Beamformer 305. Like the Tx Beamformer, a simple ±90° phase shift yields ±30° beams, respectively. The 30° beams are translated by the RF to the same IF 310 used by the transmitter where they can be bandpass sampled by the Analog-to-Digital (A/D) Converter 311 at a sampling rate of 40 Msps, a reasonable rate for current 10-12 bit A/D converters, providing ample resolution for the RLSH application. The Detection Processing 312 is typically performed in the same FPGA, for the prototype, or ASIC, for the production system, used for transmit signal generation. Bandpass sampling at 40 Msps moves the IF frequency to 10 MHz. Detection Processing includes translating the spectrum to baseband from the digital IF at 10 MHz and filtering. Once at baseband, the sampling rate can be decimated to the minimum sampling rate of twice the bandwidth, 4 Msps, to minimize the required processing load. Digital clutter processing, using a two pulse canceller[6], is applied to remove returns from stationary targets such as trees, ski lift towers, or resting skiers and snowboarders. A digital correlator matched to the 1024 chip Hadamard code is then performed while the correlator output is monitored for threshold crossings indicative of detecting a valid radar return. The threshold will be set to guarantee a probability of detection ($P_d$)>99.99% and a Probability of False Alarm ($P_{fa}$) $<10^{-6}$. A valid radar return stops the radar range gate timer started by the transmitter and provides the accumulated round trip time (to and from the target) to the range determination algorithm. Note that proper care must be taken to calibrate (precisely measure) the transmitter and receiver delays in order to refer the true, over the air signal timing measurement to the antenna, while excluding all system delays. The Signal-to-Noise Ratio (SNR) at the correlator output, used to determine $P_d$ and $P_{fa}$, will be estimated below in the Performance section. Once an appropriate radar return is detected in one of the 30° beams, an appropriate Audio Alert 313 will be generated and channeled to the corresponding Left 314 or Right 315 Earphone. The receiver Timing and Control function in the GPP 308 controls the flow of the signal from the T/R switch through the receiver to the earphones where the user is alerted to the encroaching skier/snowboarder.

[6]A. Oppenheim, *Applications of Digital Signal Processing*, Prentice Hall, Englewood Cliffs, N.J., 1978, page 310.

Performance

Figure 4:
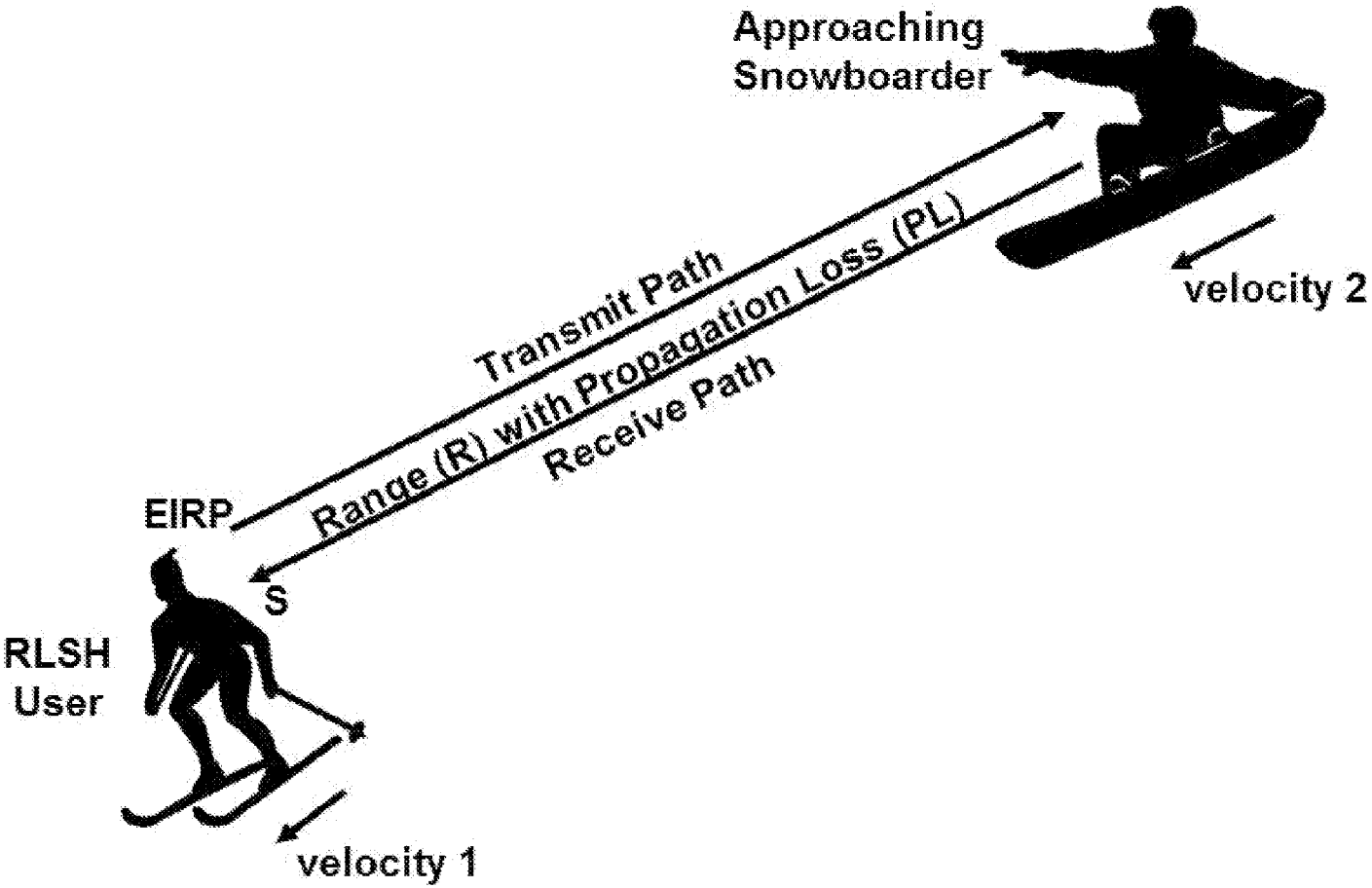
FIG. 4 is a snapshot of a Rear Looking Snow Helmet user with encroaching snowboarder to illustrate RF link budget and timing calculations.

FIG. 4 will be used to illustrate the calculation of SNR and time based parameters in order to determine feasibility of the RLSH. SNR is used to determine $P_d$ versus $P_{fa}$ and location accuracy. Time related variables include coherence time and total reaction time.

Performance—SNR Related Parameters

SNR determination begins with transmit power and a link budget. A low value of transmit power (2 mW) was selected to eliminate harmful RF radiation to the user. The link budget is used to predict the received SNR back at the RLSH after a radar signal is transmitted, propagates to the approaching skier/snowboarder, reflects off the approaching skier/snowboarder then propagates back to the RLSH.

Referring to FIG. 4, Effective Isotropically Radiated Power (EIRP) is:

$$\text{EIRP}=P_T-L_C+G_A \tag{1}$$

where:

$P_T$=10 LOG(2 mW)=3 dBm, $L_C$=cable losses=0.5 dB (assumed), and $G_A$=antenna gain (or loss)=−5.5 dB (assumed), yielding EIRP=3−0.5−5.5=−3 dBm.

Figure 5:
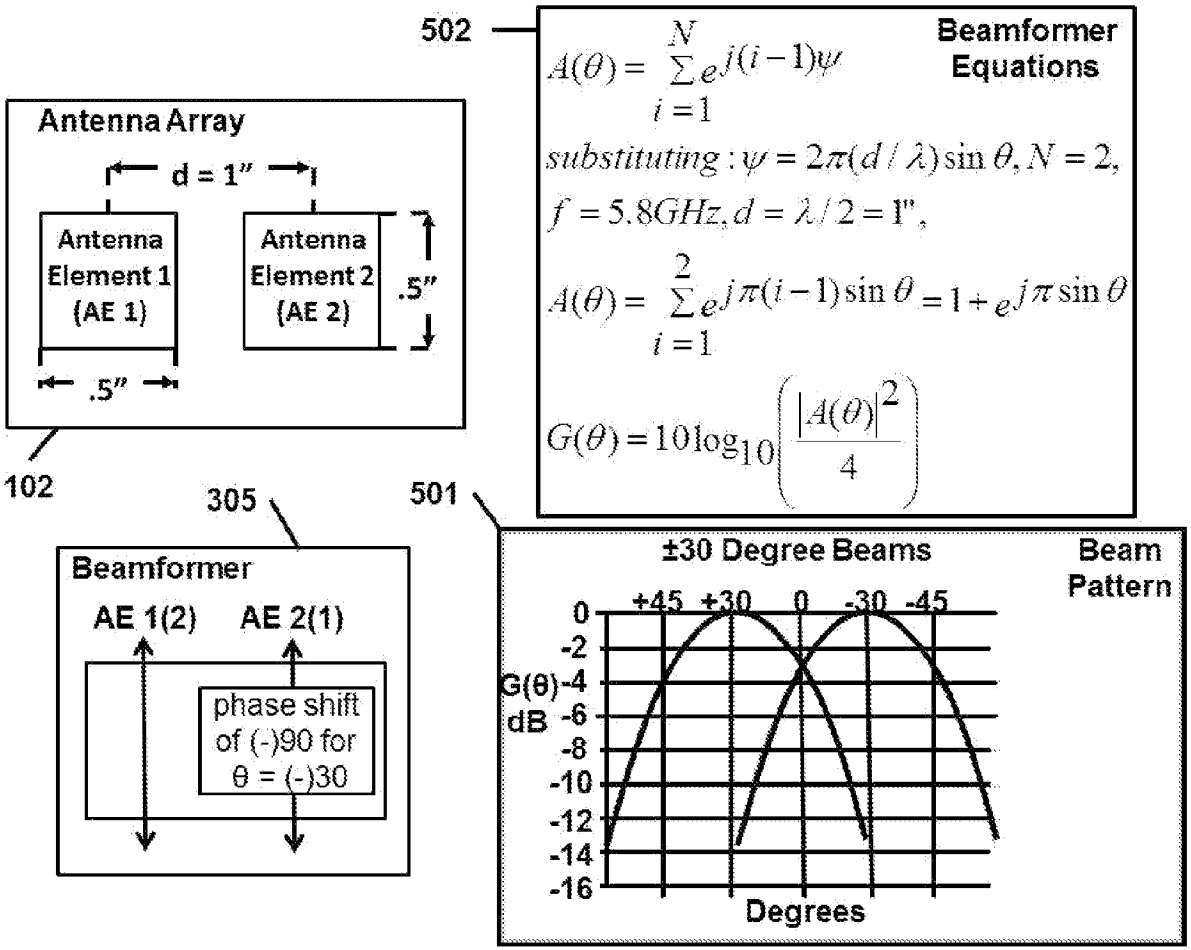
FIG. 5 shows the antenna array layout, the beamformer, the beamformer equations, and the beampattern for the ±30° beams of the Rear Looking Snow Helmet.

As shown in FIG. 5, the Antenna Array 102 consists of two 0.5"×5" dielectric antenna elements (by TOKO, for example) that are combined through a simple beamformer 305 to provide ±30° beams at −3 dB 501. Equations for the beamformer 502 are also shown in FIG. 5 where a phase shift of (−)90° is used to generate the (−)30° beam, respectively 501. Antenna gain (or loss) above is determined at the worst case magnitude, −3 dB, along with an assumed additional −2.5 dB to account for other antenna related losses resulting in a total loss of −5.5 dB.

Referring again to FIG. 4, the radar signal is transmitted from the antenna at EIRP=−3 dBm and propagates to the prospective target (approaching skier/snowboarder) over a range R, reflects according to the Radar Cross Section (RCS) of the skier/snowboarder, propagates back over the same range, R, and the signal, S, is received by the user. The Two-Ray Propagation model[7] is used to determine the Propagation Loss (PL) of the radar signal as it propagates to and from the target:

$$\text{PL}=20\ \text{LOG}(H1)-40\ \text{LOG}(R)-40\ \text{LOG}(R)+20\ \text{LOG}(H2) \tag{2}$$

where,

H1=H2=helmet mounted antenna height from ground=5'9"=1.75 m (assumed)

R=10 m (maximum range)

therefore, $$PL=20\ LOG(1.75)-40\ LOG(10)+20\ LOG(1.75)-40\ LOG(10)$$

$$PL=5-40+5-40=-70\ dB.$$

[7]T. Rappaport, *Wireless Communications Principles and Practice*, IEEE Press, NY, N.Y., and Prentice Hall PTR, Upper Saddle River, NJ, 1996, page 89.

Given the propagation loss, a link budget can be derived for the received signal strength, S, at the input to the user receiver:

$$S=EIRP+PL+RCS+G_A-L_C \quad (3)$$

where,

RCS of the approaching skier/snowboarder=−3 dB[8]

$$S=-3-70-3-5.5-0.5=-82\ dBm.$$

[8]T. Doraru and C. Le, "Validation of Xpatch Computer Models for Human Body Radar Signatures," Army Research Laboratory, ARL-TR-4403, March 2008.

Knowing that a typical off-the-shelf, 3rd ISM band receiver[9] has a noise floor, N=−92 dBm, the SNR at the receiver input, $SNR_i$, can be determined:

$$SNR_i=S-N(dB)$$

$$SNR_i=-82-(-92)=10\ dB. \quad (4)$$

[9]Altan ALT5801, 5.8 GHz Transceiver Module, Altan Technologies, June 2009.

The SNR at the output of the correlator, $SNR_o$, is then determined as:

$$SNR_o=SNR_i+PG \quad (5)$$

where,

PG=Processing Gain=10 LOG(correlator length)=10 LOG (1024)=30 dB.

Substituting into (4) yields, $$SNR_o=10+30=40\ dB.$$

From Whalen[10], an output $SNR_o$=16 dB supports $P_d$=99.9% and $P_{fa}=10^{-8}$ leaving a 24 dB margin. The entire $SNR_o$=40 dB is needed to achieve reasonable location accuracy for the example system being proposed. Other and future systems could tradeoff increased bandwidth (BW) versus $SNR_o$ to reduce transmit power or antenna efficiency, for example, to reduce the margin and associated costs. As shown below, bandwidth is directly proportional to location accuracy in time, $\sigma_t$, which is estimated using the Cramer-Rao Bound (CRB)[11]:

$$CRB=1/(BW\times SNR_o^{1/2})=\sigma_t$$

$$\sigma_t=1/[2\times10^6\times(10{,}000)^{1/2}]=5\times10^{-9}=5\ ns, \quad (6)$$

where the range error in meters is, $$\sigma_r=\text{speed of light}\times\text{time}=3\times10^8(m/s)\times5\times10^{-9}(s)=1.5\ m.$$

[10]A. Whalen, *Detection of Signals in Noise*, Academic Press, New York, 1971, p 248.

[11]H. Poor and G. Wornell, *Wireless Communications Signal Processing Prospectives*, Prentice Hall, Upper Saddle River, NJ, 1998, p 383.

A range error of $\sigma_r$=1.5m is sufficient to allow several warnings of an encroaching skier/snowboarder first detected at a range of 10m.

Performance—Time Related Parameters

Moving on to the time related parameters, we begin with differential velocity, Av, between the skier using the RLSH (shown in FIG. 4), moving at velocity 1 (v1) meters/second (m/s), and the approaching snowboarder, moving at velocity 2 (v2) m/s:

$$\Delta v=v2-v1\ m/s. \quad (7)$$

The speed of average downhill skiers/snowboarders is on the order of 20 mph.[12] Assuming that the encroaching skier/snowboarder is approaching at 25-35 mph, $$\Delta v_{min}=5\ mph(=7.33\ feet/sec),$$

$$\Delta v_{max}=15\ mph(=22\ feet/sec,=6.67\ meters/sec).$$

[12]http://www.trails.com/facts-9654-how-fast-do-downhill-skiers.html.

In order to reduce false alarms, the field of view is limited by the range gate to 10 m. The maximum and minimum total reaction times, $T_{Rmax}$ and $T_{Rmin}$, for the RLSH assuming a maximum range of 10m (33 feet) and the above differential velocity assumptions are:

$$T_{Rmax}=33/\Delta v_{min}=33/7.33=4.5\ sec, \quad (8)$$

$$T_{Rmin}=33/\Delta v_{max}=33/22=1.5\ sec. \quad (9)$$

A simple Sequencing and Alerting Algorithm is used to support the short reaction and alerting times and evade approaching skiers/snowboarders.

1. Transmit (ping) every 0.5 second in alternate)(±30° beams.
2. If approaching skier/snowboarder is detected:
   a. Provide a warning and ping in the same beam until the range <2m,
   b. Provide warnings with increased audible frequency after each ping as the range decreases to <2m,
   c. Warn RLSH user within 0.5 second during each ping cycle including detection processing, keeping up with real time.
3. Resume by pinging in the alternate beam.
4. Continue alternate beam pinging until another approaching skier/snowboarder is detected and repeat the algorithm.

Figure 6:
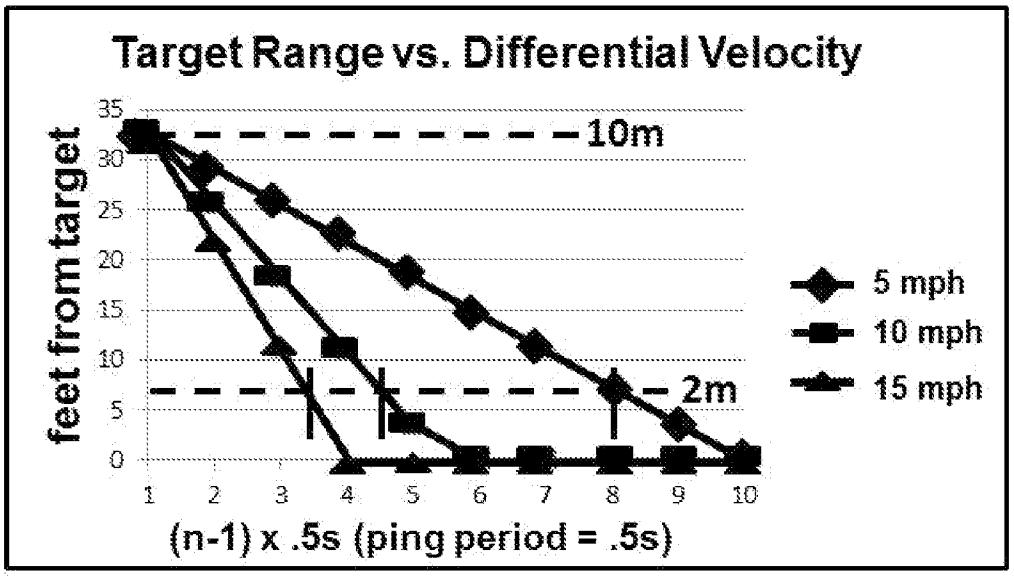
FIG. 6 is a plot showing the number of achievable pings between the 10 m initial detection and 2 m threshold versus three realistic differential velocities for the Rear Looking Snow Helmet.

As shown in FIG. 6 for examples of 15, 10, and 5 mph differential velocities, there is time for 2, 3, and 7 pings, respectively, between the 10 m initial detection and the 2m threshold where successive detections are indicated with increasing audible frequency.

Coherence time, $T_c$, the final time related parameter, is the time over which a signal can be coherently integrated. $T_c$ is related to wavelength, λ, of the transmitted signal and the maximum differential velocity, $\Delta v_{max}$, between the user and the encroaching skier/snowboarder[13]:

$$T_c\approx0.423\lambda/\Delta v_{max},$$

$$T_c\approx0.423\times0.52/6.67\approx3.3\ ms. \quad (10)$$

[13]T. Rappaport, Wireless Communications Principles and Practice, IEEE Press, NY, N.Y., and Prentice Hall PTR, Upper Saddle River, N.J., 1996, page 166.

From FIG. 2, the required coherent correlation time is 0.5 ms, a value much less than $T_c$ indicating that the system will achieve its maximum processing gain of 30 dB which was used in the link budget above to calculate other performance related parameters.

What is claimed is:

1. A method used for warning a skier/snowboarder of an approaching skier/snowboarder from the side or behind, comprising:

a. A transmitter portion of a rear looking radar system module mounted within the skier's/snowboarder's helmet using: 2 MHz bandwidth, 5.8 MHz center frequency, 2 mW transmit power, direct sequence spread spectrum with binary phase shift key modulation and 1024 chip Hadamard code symbols and a radar range gate timer set to 4.5 s at transmission;

b. A two element antenna array mounted within or on a rear surface of the skier's/snowboarder's helmet used in conjunction with transmit and receive beamformers to form ±30° beams;

c. A receiver portion of said rear looking radar system module (mounted within the skier's/snowboarder's helmet) using: said radar range gate with 10 m maximum range, clutter processing to remove returns from stationary targets, a correlator matched to the 1024 chip Hadamard code, a threshold monitoring mechanism to declare a valid radar detection and turn off the radar range gate timer, and a range determination algorithm;

d. A timing and control portion of said rear looking radar system module that includes a sequencing and alerting algorithm to control radar ping sequencing and user alerts;

e. Right and left earphones mounted inside the skier's/snowboarder's helmet to which range proportional, variable frequency audio alerts are directed indicating range and direction to a detected target;

f. A rechargeable battery mounted within said rear looking radar system module with a recharging interface mounted on a surface of the helmet; and g. A large ski glove friendly ON/OFF switch mounted on a surface of the skier's/snowboarder's helmet for easy access when transitioning to high false alarm rate areas.

2. The method of claim 1 wherein:

a. The rear looking radar system technology, parameters, mechanical configuration and physical mounting configuration can be varied;

b. The audio alert function technology, parameters, mechanical configuration and physical mounting configuration can be varied;

c. The ON/OFF switch technology, parameters, mechanical configuration and physical mounting configuration can be varied; and d. The battery technology, parameters, mechanical configuration and physical mounting configuration can be varied.

3. The method of claim 1 except used for warning a pedestrian of an approaching pedestrian (intending or not intending harm) or vehicle from the side or behind wherein:

a. The rear looking radar system technology, parameters, mechanical configuration and physical mounting configuration can be varied;

b. The audio alert function technology, parameters, mechanical configuration and physical mounting configuration can be varied;

c. The ON/OFF switch technology, parameters, mechanical configuration and physical mounting configuration can be varied; and d. The battery technology, parameters, mechanical configuration and physical mounting configuration can be varied;

e. The system could be mounted within a hat or object of clothing or standalone.

* * * * *